US005626158A

United States Patent [19]

Gratopp

[11] Patent Number: 5,626,158

[45] Date of Patent: May 6, 1997

[54] PAINT ROLLER WASHER AND DRYER

[76] Inventor: Merlin Gratopp, 766 Michigan, Lincoln Park, Mich. 48146

[21] Appl. No.: 156,734

[22] Filed: Nov. 24, 1993

[51] Int. Cl.[6] ..... B08B 3/02

[52] U.S. Cl. ..... 134/138; 15/230.11; 15/248.2; 134/900

[58] Field of Search ..... 134/900, 138, 134/144, 198; 15/230.11, 248.2

[56] References Cited

U.S. PATENT DOCUMENTS

| | | | |
|---|---|---|---|
| 2,938,368 | 5/1960 | Bixel | 134/900 X |
| 3,133,548 | 5/1964 | Carr | 134/138 |
| 3,139,891 | 7/1964 | Faustman | 134/900 X |
| 3,422,828 | 1/1969 | Dommer | 134/900 X |
| 3,748,683 | 7/1973 | Smith et al. | 15/248.2 |
| 3,942,209 | 3/1976 | Walls | 15/248.2 X |
| 4,254,529 | 3/1981 | Cooke | 15/248.2 X |
| 4,569,099 | 2/1986 | Harding | 134/900 X |
| 4,667,363 | 5/1987 | Calvert | 134/900 X |
| 4,765,353 | 8/1988 | Rhoades | 134/900 X |
| 5,095,575 | 3/1992 | Jarecki et al. | 15/248.2 X |

*Primary Examiner*—Philip R. Coe

[57] ABSTRACT

Disclosed is a novel means for cleaning a paint roller brush. At the end of a painting operation, the painter sets the cylindrical applicator portion of the roller into a cradle having slots located at the ends for supporting the applicator axle at a central elevation which allows the applicator to free wheel, or spin. The roller handle is then brought around to rest in an opening located in the handle portion of the present invention and is rigidly held there during the cleansing operation. The painter then attaches a fluid source to a nozzle assembly slidably attached to rails located along the cradle wall. The pressurized fluid exits the nozzle through a plurality of spray jets onto the applicator at such an angle as to cause it to spin. The painter reciprocally moves the spray the entire length of the applicator until clean. The spin thereby centrifugally displaces the back wash, leaving the applicator relatively dry.

5 Claims, 2 Drawing Sheets

50
51
56
54
52
57
53
55

PAINT ROLLER WASHER AND DRYER

TECHNICAL FIELD

This invention relates in general to the cleaning and maintenance of cylindrical paint applicators, said applicators being generally detachable from a support roller structure and widely in use.

BACKGROUND OF THE INVENTION

One of the most effective ways to apply paints and finishes to any given surface is the paint roller type brush. It is also one of the most difficult to clean due to the cylindrical nature of its design and the high absorbency of its outer surface. One method of cleaning the brush is to expend as much paint from the pile, or nap, surface to the work area as possible. The brush is then engaged with a fluid which is used to flush the remaining paint from the nap. As the brush is cylindrical and free-wheeling, the above method is at best very messy and cumbersome. Any given amount of paint, however minute, left in the brush after cleansing will set up and harden, rendering the brush useless; and, as the brush is usually stowed away wet or damp, the above is not discovered until the brush is again pressed into service. An additional difficulty with residual paint left in the brush is making the transition to another color or type of paint which can alter the shade of the new paint and go undetected until the paint dries.

As the brush is usually detachable from the handle, one could simply discard the brush and install a new one. This option, however, requires physical contact resulting in a new set of cleansing difficulties as well as the additional cost of replacement brushes.

Another option would be to use a designated paint roller cleaning device. These devices found in the prior art require the insertion of the brush into a canister device having a means for dispersing fluid under pressure to the surface of said brush. The mechanical nature of these devices require more operational steps than the old cleaning methods they were designed to eliminate. The cost alone for these cleaners exceed what most users would spend.

A main objective, therefore, of the present invention is to provide an inexpensive means for painters to not only clean the roller brush with a fluid, but cause the fluid to be spun away from the brush, thereby leaving said brush dry for immediate use with a new color or composition, or to be stowed away.

It is also the objective of the present invention to provide the user with a shielding means which prevents the paint-laden rinsing fluid from coming in contact with surfaces not intended, and indeed allows the user to better control the wash drainage.

A further objective of the present invention is to provide the user with a means for attaching a fluid source to the said present invention using a common standard coupling device.

Therefore, by combining the above-stated objectives, an additional objective of the present invention provides for the ease and rapid process of cleaning and maintaining cylindrical paint applicators economically.

SUMMARY OF THE INVENTION

In light of the foregoing problems, and to fulfill the above-stated objects, there is provided, according to one aspect of the present invention, a cost effective paint roller cleaning device which allows the painter to set the entire brush portion of a paint roller into a shielded cradle, allows for easy hook-up of a fluid source, allows for positive dispersion of spent fluid used to rinse said recessed brush, and allows continual use of said paint roller without having to wait for said brush to dry.

Clearly stated, a preferred embodiment of the present invention has a brush cradle portion, a fluid-dispensing nozzle, and a dominant sub-handle rigidly attached to the closed underside of the brush cradle, said sub-handle comprising a means for allowing the insertion of most paint roller handles.

The half round style cradle provides for different lengths of paint roller brushes to be inserted with 12 inch being the most common length used. Situated at each long edge of the brush cradle are means for allowing the fluid nozzle to be slidingly controlled laterally during the cleaning operation. Once the brush is set into the cradle, and the paint roller handle set into a recess in the sub-handle of the present invention and firmly held there by the user, the fluid nozzle, affixed to a fluid source, is opened allowing a pressurized jet spray to impact the roller brush at such an angle as to cause the brush to spin. The fluid dilutes the paint at the point of contact and is centrifugally discharged at the opposite free opening. The captive nozzle is the moved by hand along the entire length of the brush at a regulated pace until the paint has been removed by the jet spray. The nozzle is then disengaged and the paint roller detached.

It is foreseen that the present invention could be manufactured from a number of readily available composites and polymers, or stamped from metal.

Another embodiment of the present invention has a paint roller brush cleaner with a detachable sub-handle which can be slid into a channel in order to receive different paint roller handle lengths. Said detachable handle has a cam-locking means which is used to lock the handle in place. The handle is rotated 90° causing the cam lobes to engage the side walls of the channel. This feature also allows the handle to be removed, thereby reducing the amount of storage space or packaging space needed. The removable feature also allows for other stabilizing attachments to be used. For example, a clamping device with the same cam-lock feature could be used to attach the present invention to the edge of a laundry tub to facilitate paint roller brush cleaning during winter months, or when outdoor cleaning is hampered by weather. This feature would also benefit those who have no outdoor cleaning capabilities such as apartment dwellers and the like.

In still another embodiment of the present invention, the brush cradle portion is made from a clear polymer material which will allow the painter greater visual control of the process.

By these embodiments, one can see that there is provided a new and useful means for cleaning and maintaining cylindrical paint applicators. Accordingly, these and other features will no doubt occur to those skilled in the art upon the study of the following detailed description of the preferred embodiments, taken in conjunction with the attached drawings and claims.

BRIEF DESCRIPTION OF THE DRAWINGS

In the drawings where like reference numerals are used to indicate identical components in the various figures.

DETAILED DESCRIPTION OF THE EMBODIMENTS

Figure 1:
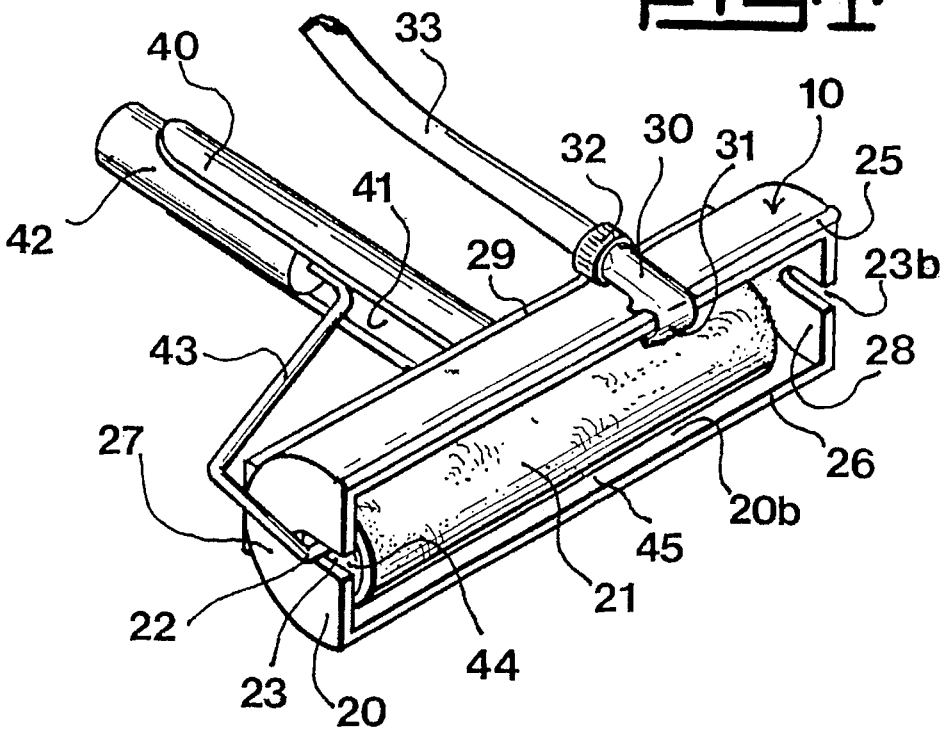
FIG. 1 is a perspective view of the preferred embodiment showing the relativity of a common paint roller to the present invention.

With combined reference to all the figures, a brush cleaner for paint rollers is denoted by the numeral 10. As seen in FIG. 1, the present invention 10 comprises a cradle 20 which encompasses a cylindrical paint applicator 21. Said applicator 21 is centrally displaced within said cradle 20 so as to allow the applicator 21 to free-wheel. The applicator rotates on an axle 22. Said axle 22 runs through a hub 44, through the interior length of the long axis of the applicator 21, and exits through an opposite hub (not viewed). Situated in a first bulkhead 27 is a first axle support notch 23 which engages the axle 22, thereby elevating the applicator 21 for cleansing. Situated at the opposite end of the cradle 20 is a second bulkhead 28 and second axle support notch **23*b* which allows the present invention 10** to be used ambidextrously.

Located at each termination of the cradle wall **20*b* are guide rails 25 and 26 which are used to slidably control a fluid nozzle 30. Said nozzle 30 has a plurality of jets 31 which direct a given pressurized fluid at such an angle to the applicator 21 as to cause it to spin. By manually sliding the nozzle 30 along the rail 25 or 26 at a regulated pace, the rotation allows uniform fluid contact with the paint to be cleansed. As the nozzle 30 passes an area, the free-wheeling movement causes the back wash to be spun off the applicator 21, thereby spin-drying said applicator 21. Located intermediate of nozzle 30 and fluid conduit 33 is a standard hose fitting 32. Said fitting 32** adapts to most garden hoses.

Situated along the backside of the cradle 20 is a channel 29 which allows the insertion of a secondary cradle 40 and the rigid support thereof. Said cradle 40 has an access opening 41 for receiving a paint roller handle 42. The user generally holds said handle 42 tightly to the cradle 40 with one hand, while sliding the fluid nozzle 30 with the other. Located between said handle 42 and applicator 21 is a rod 43. Said rod 43 aids in supporting the applicator 21 during the cleansing operation. Located at the front of the cradle 20 are openings 45 which allow the positive discharge of the rinse fluid.

Figure 2:
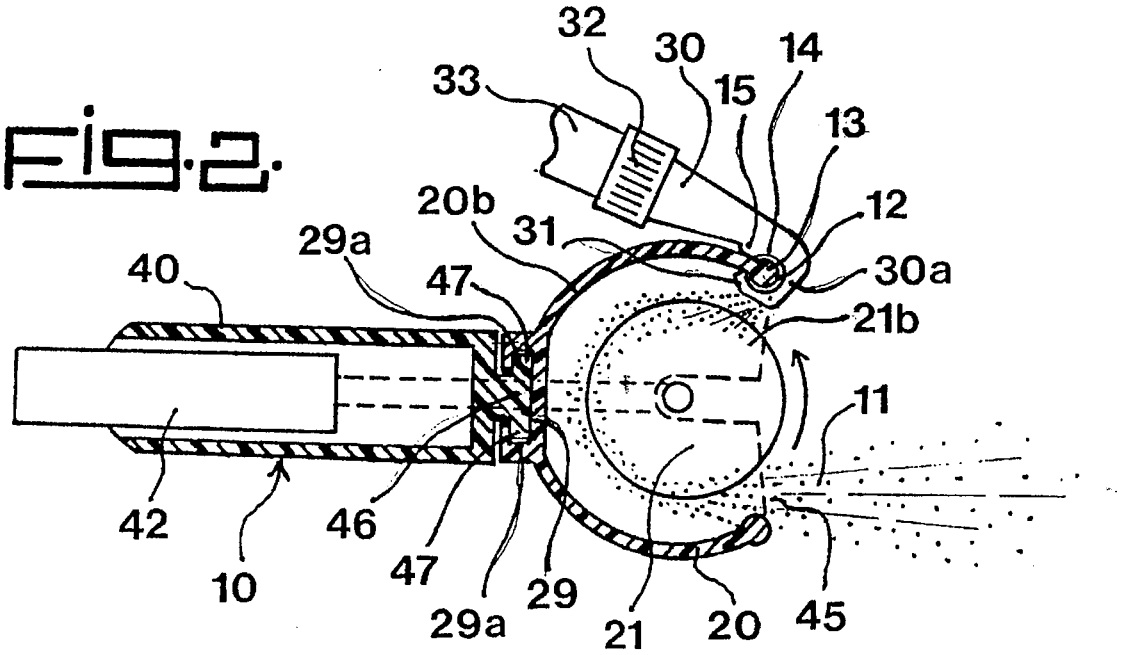
FIG. 2 is a side view, in partial cross section, of the present invention showing the typical fluid travel.

FIG. 2 shows a side view of the preferred embodiment 10. As viewed, a fluid source 33 is connected to a nozzle 30 by means of a hose fitting 32. As a fluid gate is opened, the fluid 11 (usually water), is passed through a plurality of jets 31 and engages the applicator 21 at such an angle as to cause said applicator 21 to rotate. The fluid 11, being under pressure, forces the paint away from the nap **21*b*, and the user generally allows several revolutions of the applicator 21 to assure positive displacement of the paint, which is discharged through opening 45. The user of the present invention 10 then causes the nozzle 30 to slide along the top edge 12 of the wall member 20*b* of the cradle 20. The nozzle is restrained from separating said edge 12 by means of a tongue 13 and groove 14, said tongue 13 being located at the termination of said wall member 20*b*, and the groove 14 being located in the nozzle head 30*a*. The nozzle 30 can be manually separated from the cradle 20 by lifting up on the rear portion of the nozzle assembly 16, thereby causing the lip 15, located at the radial beginning of the groove 14, to be forced over the tongue 13. To reattach the nozzle 30**, the aforementioned procedure is reversed.

Situated along the rear portion of the applicator cradle 20 is a channel member 29 which allows the paint roller handle cradle 40 to be rigidly affixed to said cradle 20 by means of a cam head 46. The cradle 40 is inserted into the channel 29 to a desired position and is rotated 90°, thereby causing lobes 47, being slightly larger than the width of the channel walls **29*a*, to engage said walls 29*a* and bind itself therebetween. The position of the cradle 40 is usually dependent on the location of the paint roller handle 42** which vary in dimension from one another.

Figure 3:
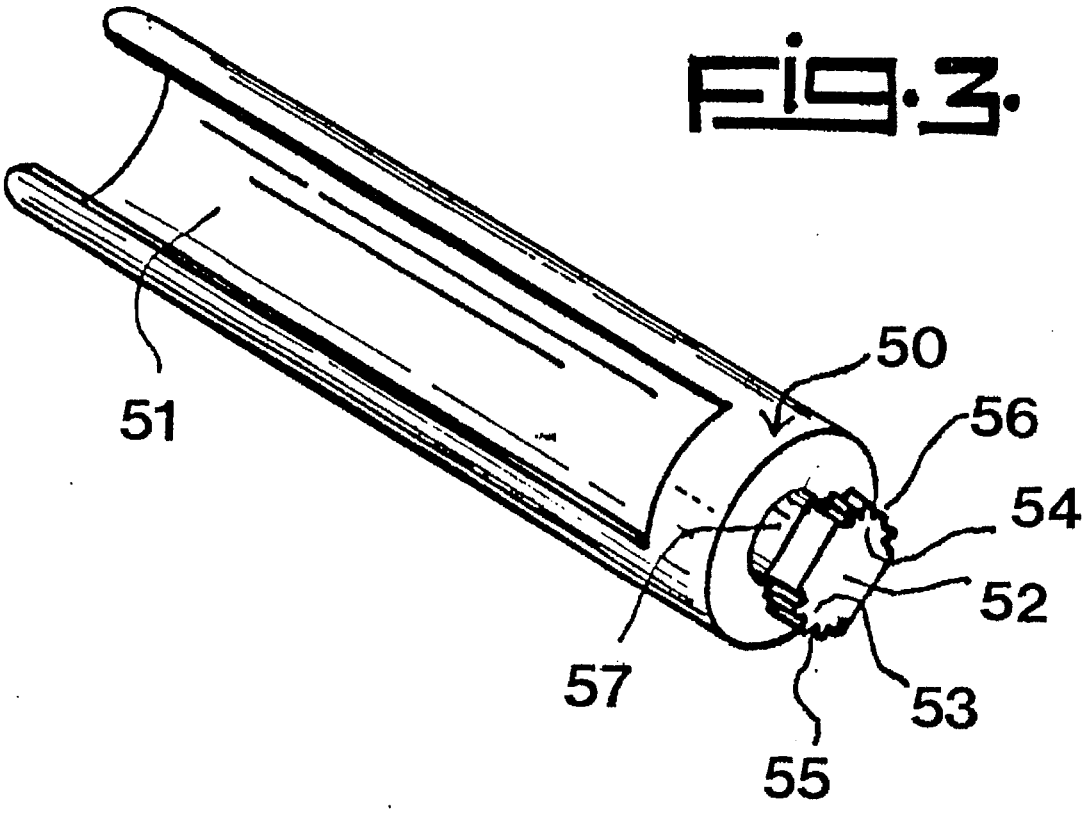
FIG. 3 is a perspective view of the handle component of the present invention. Depicted is the cam locking means for rigidly displacing said handle between the proximal and distal ends of the applicator cradle.

FIG. 3 shows a preferred embodiment of the paint roller handle cradle 50. Being detachable and relocatable, the cradle 50 allows most paint roller handles (not viewed) to be inserted into access opening 51. The cradle 50 is locked into place using a cam 52 whereby a first cam lobe 53 uses a plurality of stress ribs 55 to engage a side wall of a channel in conjunction with a second cam lobe 54 having a plurality of opposing stress ribs engaging the opposing side wall of said channel member (as viewed in FIG. 2, reference **29*a*). Once the cradle 50 is in position, it is rotated 90°, thereby causing the aforementioned stress ribs 55 and 56 to compress slightly, thereby rigidly retaining said cradle member 50** within the matrix of said channel member.

While the foregoing embodiments of the present invention are well suited to achieve the above-stated objects, those skilled in the art should realize that such embodiments are subject to modification, alteration, and change without departing from the spirit and scope of the present invention. For example, the fluid nozzle assembly 16 could also have a valve member incorporated therein. Said valve member being widely cited in the prior art and so was not defined herein.

As another example, the present invention could have a means for being rigidly held within a bucket thereby containing potentially toxic fluid/paint mix from contaminating any given environ.

In still another example, instead of the fluid nozzle sliding along a monotrack, an interior channel track could be used. Also the fluid dispersion means could incorporate an elongated slot instead of spray jets.

Other variations will no doubt occur to those skilled in the art upon the study of the description and drawings contained herein. Accordingly, it is to be understood that the present invention is not limited to the specific embodiments described herein, but should be deemed to extend to the subject matter defined by the appended claims, including all fair equivalents thereof. Therefore having described my new and useful invention in specific terms, I make the following claims.

I claim:

1. A paint roller washer and dryer comprises a walled semi-circular roller brush cradle having oppositely displaced nubs comprising the termination of the walled cradle edges, said walled cradle cross terminating with bulkheads having slots for rigidly maintaining a paint roller brush support rod thereby allowing a free-wheeling elevation of a paint roller brush within said walled cradle for the engagement of a cleaning fluid regulated through a fluid nozzle, said fluid nozzle having a channel adapted to be snapped onto the nubular edges of said walled cradle thereby allowing linear travel of said fluid nozzle for dispensing fluid against a soiled paint roller brush at such an angle as to cause said soiled paint roller brush to centrifugally dislodge both soil and backwash respectively.

2. The paint roller washer and dryer of claim 1 whereas a semi-circular handle is attached to the convexity of said walled cradle and is transmoved within a channel located on the convex surface of said walled cradle and locked thereat to receive multiple paint roller brush handle sizes within the concavity of said semi-circular handle.

3. The semi-circular handle of claim 2 whereas a cam lobe, having resilient ribs oppositely displaced thereon, comprises one end of said semi-circular handle, whereas said cam lobe is moved freely within said channel of said walled cradle to a point of contact with a paint roller brush handle, and is there rotated to bias said resilient ribs, located at the long ends of said cam lobe, against the inner side walls of said channel thereby maintaining a fixed position allowing a user to bias a paint roller brush handle within the concavity of said semi-circular handle thereby regulating the free-wheeling elevation of a paint roller brush within said walled cradle to facilitate its washing and drying.

4. A paint roller washer and dryer of claim 3 whereas said fluid nozzle channel comprises a semi-circular opening terminating with opposite restricting nubs having an access span smaller than the width of the nubular edges of said walled cradle, whereas said restricting nubs are resiliently biased over said nubular edges, said restricting nubs relaxing once said fluid nozzle channel is mated to said nubular edge, maintaining a loose wall tolerance therebetween.

5. A paint roller washer and dryer of claim 1 whereas said fluid nozzle channel is adapted to the nubular edges comprising the ends of the cradle walls, said nozzle is connectable to a common fluid source.

* * * * *